US006038698A

United States Patent [19]

Lawler

[11] Patent Number: 6,038,698

[45] **Date of Patent: *Mar. 21, 2000**

[54] TOY ANIMAL AND HABITAT CLOTHING

[76] Inventor: John J. Lawler, 14 Westerly Dr., New City, N.Y. 10956

[ * ] Notice: Under 35 U.S.C. 154(b), the term of this patent shall be extended for 736 days.

[21] Appl. No.: 08/497,634

[22] Filed: Jun. 30, 1995

Related U.S. Application Data

[63] Continuation of application No. 08/205,658, Mar. 4, 1994, abandoned.

[51] Int. Cl.[7] ..... A41B 1/00

[52] U.S. Cl. ..... 2/69; 2/115; 40/586; 446/100

[58] Field of Search ..... 2/69, 69.5, 246, 2/247, 115, 243.1, 244; 40/586; 428/15, 16, 17, 18, 19; 446/268, 100, 28, 901

[56] References Cited

U.S. PATENT DOCUMENTS

| | | | |
|---|---|---|---|
| 2,628,452 | 2/1953 | Gladstein | 2/247 X |
| 4,591,521 | 5/1986 | Freno et al. | 2/115 X |
| 4,772,503 | 9/1988 | Donsky | 2/115 X |
| 4,815,149 | 3/1989 | Erhardt | 2/243.1 |
| 4,860,387 | 8/1989 | Williams | 2/244 |
| 4,975,987 | 12/1990 | Teachout et al. | 2/246 |
| 5,005,218 | 4/1991 | Ganz | 2/69 |
| 5,203,033 | 4/1993 | Sheppard, Sr. et al. | 2/69 |
| 5,210,881 | 5/1993 | Stocker, Jr. et al. | 2/247 |
| 5,222,259 | 6/1993 | Bristor | 2/115 |

FOREIGN PATENT DOCUMENTS

| | | | |
|---|---|---|---|
| WO8802605 | 4/1988 | WIPO | 2/69 |

*Primary Examiner*—Gloria Hale
*Attorney, Agent, or Firm*—Boris Haskell

[57] ABSTRACT

A toy animal, such as a soft sculpture, is integrated with a design imprinted or depicted on an article of clothing, wherein the design depicts a habitat for the toy animal. Preferably, the design is related to a pocket, so that the animal enters the habitat by being placed in the pocket. Alternatively, or in addition, the toy animal may be appropriately mounted on the design by Velcro or other fastener means.

6 Claims, 3 Drawing Sheets

TOY ANIMAL AND HABITAT CLOTHING

This application is a continuation, of application Ser. No. 205,658, filed Mar. 4, 1994, now abandoned.

SUMMARY AND BACKGROUND OF INVENTION

The present invention relates to clothing intended to be worn primarily by children, which integrates a toy animal, such as a soft sculpture animal doll, with a design on the clothing that depicts that animal's habitat. The toy animal and the habitat design are interrelated so that the child can integrate the toy animal into the habitat design.

It is contemplated, for example, that the habitat design be related to a pocket in the clothing, so that the pocket might embody the home of the animal, and thereby permit the child to place the toy animal in the pocket, and in so doing, participate in the animal's habitat. Alternatively, or in addition, the animal may carry a Velcro patch or other fastener, or the like, and mating Velcro patches or fastening means may be strategically positioned on the habitat design. The term "Velcro" is a trademark for a form of hook and loop fastener. Again, by positioning the toy animal on one of the Velcro patches, and perhaps by moving the toy animal from one patch to another, the child participates in the animal's habitat.

The purpose of this invention is, of course, to provide amusement for small children. But in addition, the intent is at the same time to teach children about animals and their habitats, to involve the youngsters with the animal in its habitat, and thereby to raise the level of consciousness about the environment.

For example, a T-shirt (or any other type of shirt or blouse) with a pocket, may have a hollow tree stump and appropriate flora silk screened, stencilled, photolithographed, printed or otherwise applied over the pocket and its surrounding area. The tree stump is located so that the opening of the pocket becomes the open hollow of the tree stump, and a separate squirrel or chipmunk in soft sculpture form may be placed in the pocket. Thus, when the child places the animal in the pocket and removes it, the child participates in placing the animal in its home, and emerging therefrom.

In a more elaborate approach, a tree trunk and several boughs may be depicted over the front of a shirt or blouse, with a hollow opening into the trunk being depicted over the pocket. One bough might extend across the shoulder. Velcro patches or areas can be located at various appropriate locations, so that, for example, a soft sculpture owl or other bird with a Velcro patch might perch on the bough on the wearer's shoulder, and a soft sculpture squirrel with a Velcro patch may be active on another bough. A woodpecker soft sculpture might make its home in the hollow opening of the trunk by being placed in the pocket. Of course, the woodpecker, too, could have a Velcro patch so as to emerge from the pocket and be placed on the outside of the tree trunk in wood pecking position.

Obviously, innumerable combinations can be imagined, using various animals and various appropriate habitat designs. Certainly, the concept is not limited to a shirt or blouse, but is equally applicable to other items of clothing. Also, it is quite apparent that a water habitat could also be depicted, with fish, turtles, frogs and other forms of aquatic life. For example, a lily pad cluster could be designed about a thigh pocket on pants, with one lily leaf forming an actual flap over the pocket. A frog or other aquatic life could reside in the pocket, and again, by the use of Velcro, the frog could be removed from the pocket and perched on the lily pad flap. Waterfall or rapids could be designed over a pocket, and a salmon could emerge swimming up the rapids.

The incorporation of soft sculpture toys in clothing pockets is disclosed in the prior art. U.S. Pat. No. 2,628,452 fits a small doll in a blouse pocket, and the pocket is provided with holes to receive t he doll's legs, and snaps to affix the doll's arms. U.S. Pat. No. 5,210,881 fits a small teddy bear in a blouse or shirt pocket having holes to receive the four legs of the toy animal. U.S. Pat. No. 4,860,387 decorates a blouse with doll representations, and articles of clothing can be selectively applied by Velcro attachment. Of course, the decoration of T-shirts and other clothing by applying scenes of all sorts is commonplace. Several other U.S. patents of general interest are:

U.S. Pat. No. Des. 154,254
U.S. Pat. No. Des. 154,465
U.S. Pat. No. Des. 169,964
U.S. Pat. No. 4,815,149
U.S. Pat. No. 4,975,987
U.S. Pat. No. 5,005,218
U.S. Pat. No. 5,203,033
U.S. Pat. No. 5,222,259

None of this prior art combines the feature of a toy animal doll integrated with a depiction on clothing of the habitat for that animal, so that a child can become involved with the animal in its habitat on the child's clothing.

It is accordingly one object of the present invention to provide an article of clothing, such as a shirt, blouse, pants, jacket or skirt that integrates a removable toy animal doll and a design on the clothing that represents a habitat for the animal, whereby a child may become involved with the animal in its habitat.

A further object of the present invention is to provide such an article of clothing and toy doll which incorporates a pocket from the clothing in the habitat design, so as to receive the doll on the habitat.

A further object of the invention is to provide such an article of clothing and toy doll wherein the doll and habitat representation include Velcro or other fastening means to position the doll on the design.

Other objects and advantages of the invention will become apparent to those skilled in the art from a consideration of the detailed descriptions of several illustrative embodiments of the invention which are had in conjunction with the accompanying drawings.

DETAILED DESCRIPTION

Figure 1:
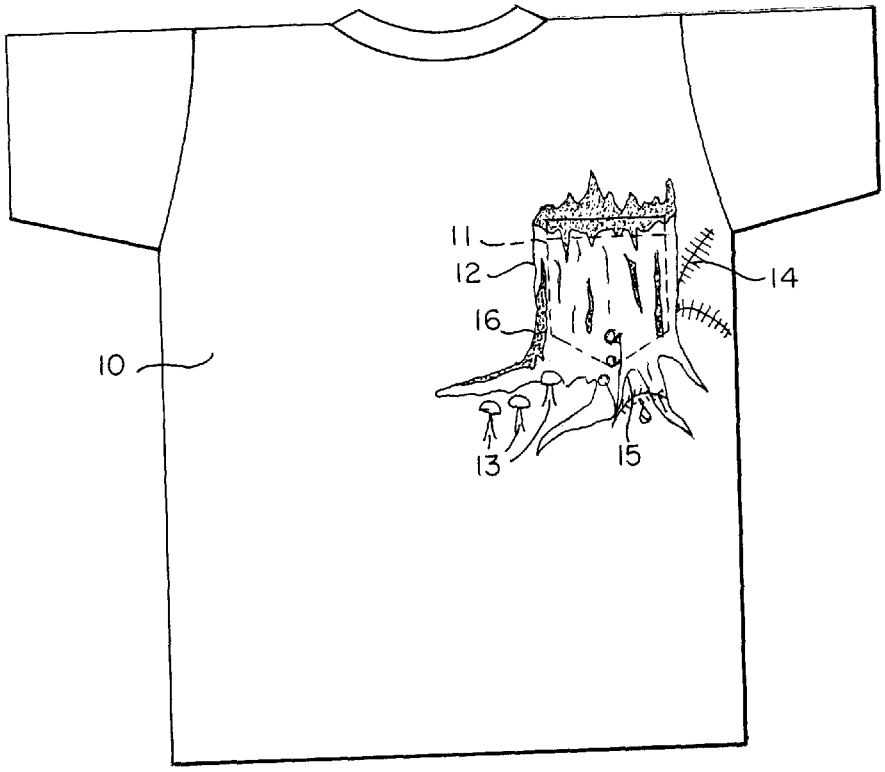
FIG. 1 is T-shirt having a hollow tree stump and surrounding flora depicted over a breast pocket, and the immediately surrounding area.
Figure 2:
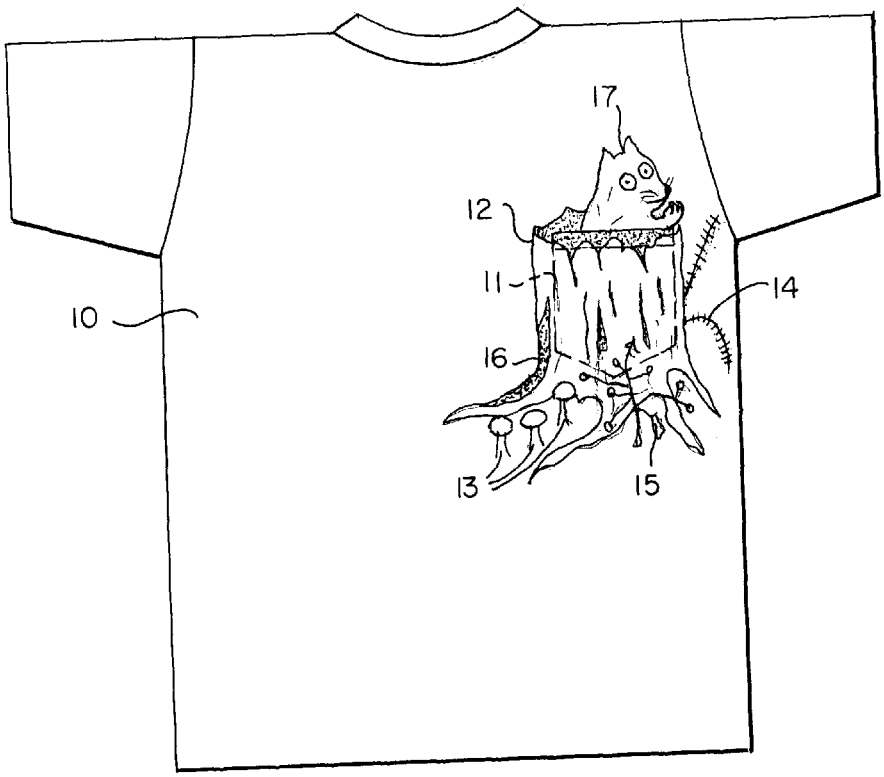
FIG. 2 is the same as FIG. 1, except a soft sculpture squirrel is shown partially emerged from the tree stump.

Referring to FIGS. 1 and 2, the T-shirt 10 has a breast pocket 11. The breast pocket is shown in broken lines because it is obscured or camouflaged by the scene that is depicted over and around the pocket. The scene may be applied to the T-shirt by silk screening or other conventional techniques. In this instance the scene is of a hollow tree stump 12, as may result from a long fallen tree in a wooded area. The hollow top opening in the tree stump 12 is located over the opening of the pocket 11. A limited amount of indigenous flora, as may be found on a forest floor, is also depicted, such as mushrooms or toadstools 13, a fern 14, a small deciduous bush 15, and moss 16. This hollow tree stump thus depicts a creature habitat.

For purposes of illustration, in this instance, the creature is a squirrel 17, which is shown in FIG. 2 as partially emerged from the hollow tree stump 12. The squirrel 17 is a three-dimensional soft sculpture, or stuffed animal toy doll. And in fact, the squirrel is partially inserted in the pocket 11, creating the illusion of emerging from the tree stump.

Thus, a child has a toy squirrel, and a meaningful place in which to carry and keep the toy, that depicts an appropriate habitat for the squirrel. By this mode of play, not only is the enjoyment of the toy enhanced, but the youngster obtains a certain understanding of the natural or wildlife environment and of the animal's habitat.

Figure 3:
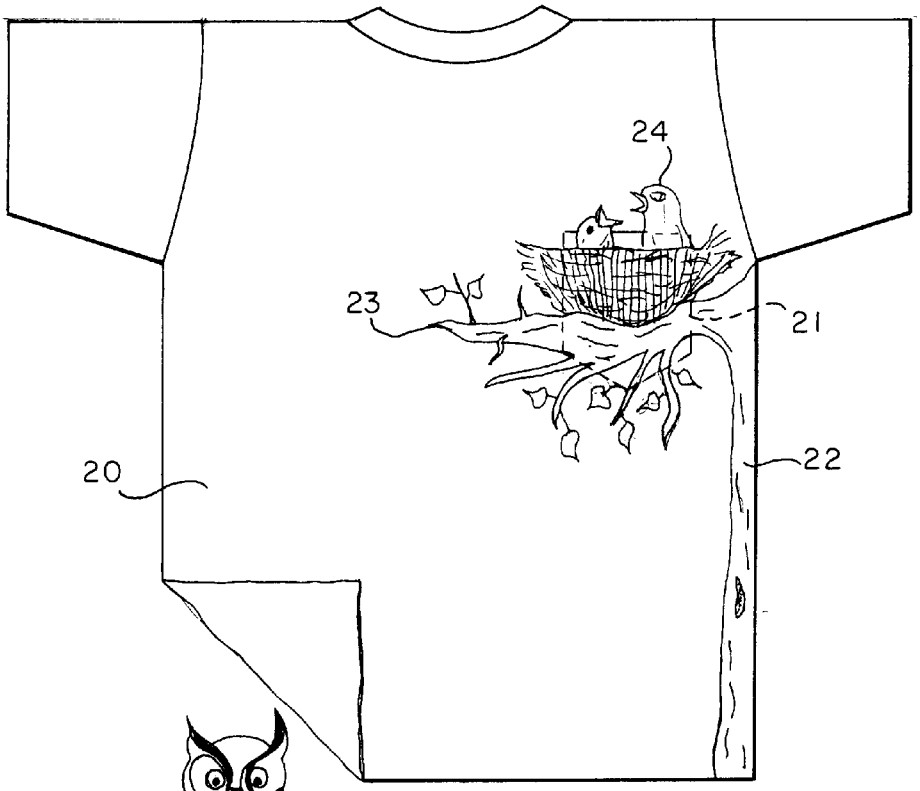
FIG. 3 is a T-shirt having a central pocket, with a tree trunk and branch holding a bird's nest depicted over the area of the pocket and surrounding portions of the shirt, and with a soft sculpture bird partially emerged from the pocket as if sitting in the nest.
Figure 5:
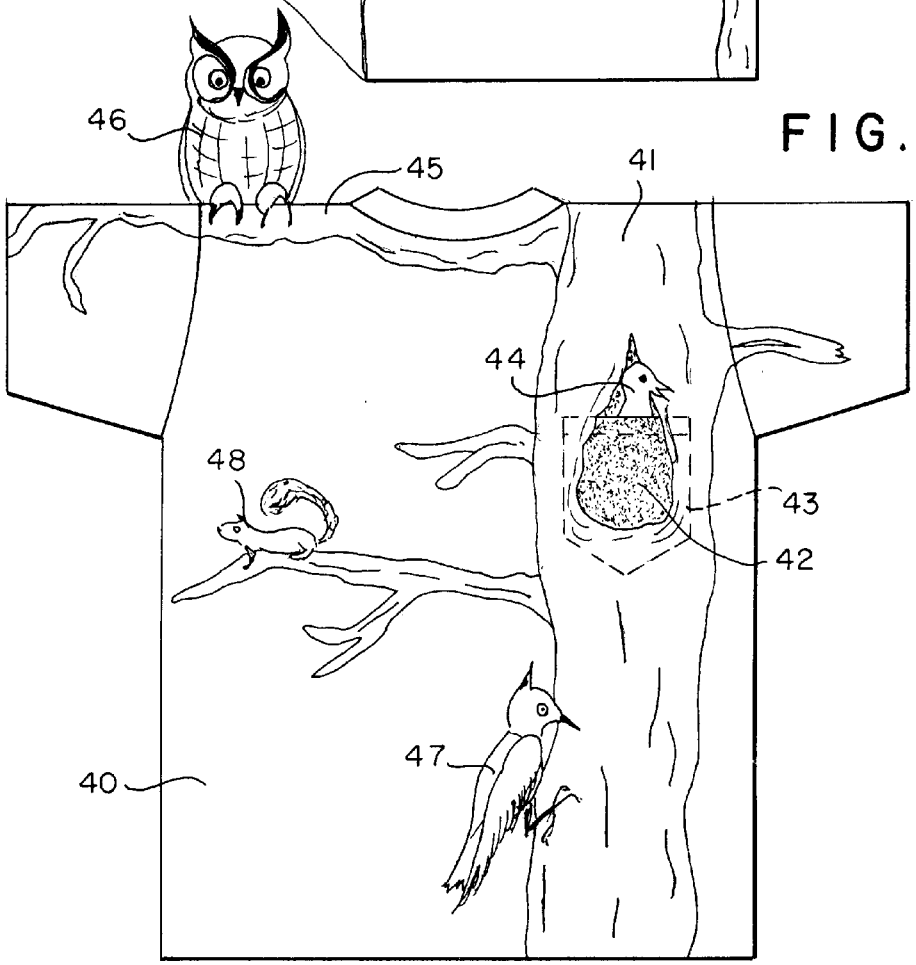
FIG. 5 is a T-shirt having a hollow tree trunk and several boughs depicted over the breast pocket, over a shoulder, and over other portions of the T-shirt, with a woodpecker soft sculpture in the pocket and partially emerged from the tree trunk, and with another woodpecker, an owl, and a squirrel, all in soft sculpture, perched on, or affixed to the tree by Velcro fastenings.
Figure 4:
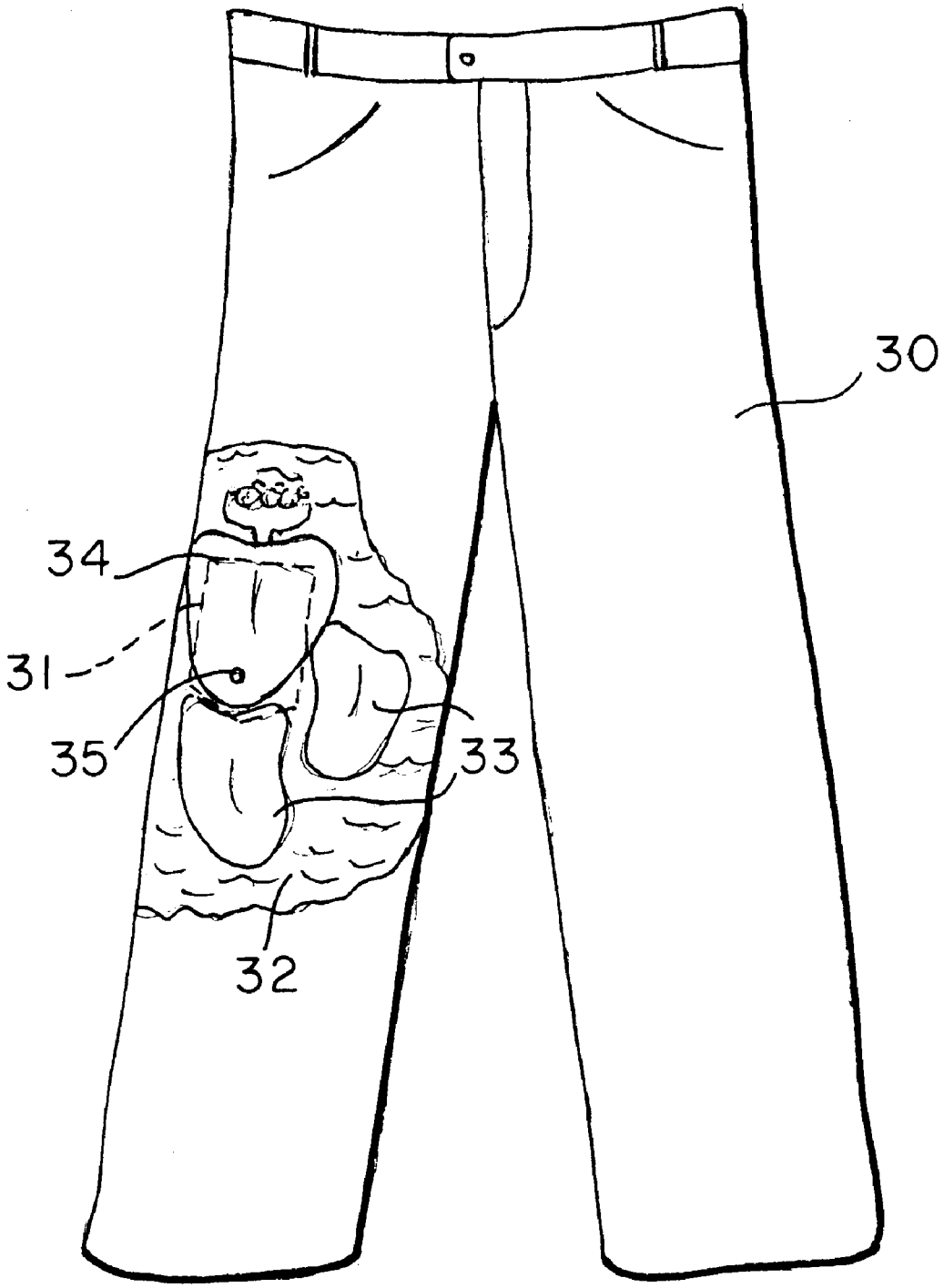
FIG. 4 shows pants with a thigh pocket having a water lily pad cluster depicted over the area of the pocket, and wherein one of the lily pad leaves serves as a flap for the pocket.

Similar results are obtained with other soft sculpture toy animal dolls and other habitats, such as are further illustrated in FIGS. 3–5.

In FIG. 3, the T-shirt 20 has a center chest pocket 21, again shown in dashed lines. A tree trunk 22 and branch 23 are depicted on the shirt, with the branch 23 extending across the pocket 21. A bird's nest 24 is depicted on the branch over the pocket, and particularly about the top opening of the pocket. The position of the nest relative to the pocket opening is such that when a soft sculpture toy bird 24 is inserted in the pocket, it enters through the top of the depicted nest. Thus, a bird placed part way into the pocket would appear to be sitting in the nest, as shown in FIG. 3.

In FIG. 4, the habitat is aquatic. Pants 30 are provided with thigh pocket 31 shown in dashed lines. An area over and surrounding the pocket is shown as the surface of a portion of a pond 32, with a water lily plant having three leaves. Two of the leaves 33 are painted or screened on the surface of the pond 32, while the third leaf 34 is a separate panel applied to the pants and forming a flap over the pocket. This flap leaf 34 may be a button down flap at 35, if desired. When the flap 34 is raised, access is had to the top opening of the pocket 31 for the insertion or removal of a three-dimensional soft sculpture aquatic toy. In this case the toy may be, for example, a frog, or a turtle, or fish, or all three if desired.

The embodiment of FIG. 5 provides an added dimension to the invention. A hollow tree trunk 41 is depicted on the T-shirt 40 having several branches and boughs. A natural opening 42 is depicted in the tree trunk over the area of breast pocket 43, shown in dashed lines. A soft sculpture woodpecker 44 can be inserted through the depicted opening 42 into the pocket 43, and can be placed part way into the pocket so as to be visible in depicted opening 42. In addition, bough 45 extends across the T-shirt and over a shoulder of the shirt. This provides a convenient perch for a soft sculpture bird, such as an owl 46. The perch may be accomplished by the use of Velcro tabs or other fasteners, on the shoulder (bough) of the T-shirt and on the feet of the owl. By use of Velcro tabs, a woodpecker 47 can be affixed to the trunk in a wood pecking position or stance. Similarly other toy animals, such as squirrel 48, can be affixed to one branch or another, or moved about on the tree. Similarily, woodpecker 44 can be removed from the pocket and affixed elsewhere on the tree by Velcro fasteners.

The foregoing embodiments of the invention are intended merely as illustrative of the invention. Numerous toy animals and forms of toy animals can be employed, although a soft sculpture or stuffed form would appear most appropriate. Likewise, innumerable habitats can be depicted. Although the habitats in all the embodiments are two-dimensional representations, it is apparent that they could, in appropriate circumstances, be three-dimensional or shown in bas-relief, in whole or in part. Moreover, numerous modifications and variations of the invention will become apparent to those skilled in the art, and such modifications and variations as are embraced by the spirit and scope of the appended claims, are contemplated as being within the purview of the invention.

What is claimed is:

1. In combination, at least one toy animal, and a garment having a pocket with an opening into said pocket, a pictorial representation applied to said garment and over at least a portion of said pocket, said representation being of a habitat for said at least one animal, said opening into said pocket being located in said pictorial representation, the pictorial representation over said pocket depicting a habitat element which has an interior space and an opening into said interior space, said opening into said pocket being coincident with said opening into said interior space, whereby the insertion and withdrawal of a said toy animal into and out of said pocket through said opening represents the entrance and emergence of such animal into and out of said interior space.

2. In the combination of claim 1, said toy animal being a three-dimensional doll.

3. In the combination of a claim 2, said three-dimensional doll being a soft sculpture.

4. In the combination of claim 1, said garment being a T-shirt, a shirt, a blouse, a skirt, a jacket or pants.

5. In the combination of claim 1, said pictorial representation begin applied by stencilling, screening, lithography or printing.

6. In the combination of claim 1, said pictorial representation has at least one fastener means and a toy animal has a cooperating fastener means, for affixing such toy animal to said pictorial representation.

* * * * *